United States Patent [19]

Klein

[11] Patent Number: 4,472,605

[45] Date of Patent: Sep. 18, 1984

[54] ELECTRODYNAMIC LOUDSPEAKER FOR LOW AND MEDIUM SOUND FREQUENCIES

[76] Inventor: Siegfried Klein, 42, rue de la tour d'auvergne, F-75009 Paris, France

[21] Appl. No.: 354,305

[22] Filed: Mar. 3, 1982

[30] Foreign Application Priority Data

Apr. 1, 1981 [FR] France ..... 81 06510

[51] Int. Cl.[3] ..... H04R 9/06; H04R 1/28; H04R 7/12; H04R 7/20

[52] U.S. Cl. ..... 179/115.5 PS; 179/115.5 R; 179/115.5 DV; 179/180; 179/181 R; 181/144; 181/153; 181/173; 381/88; 381/89

[58] Field of Search ..... 179/115.5 PS, 115.5 R, 179/146 E, 1 E, 181 R, 180, 115.5 DV, 146 R; 181/144, 145, 153, 173; 381/87, 88, 89

[56] References Cited

U.S. PATENT DOCUMENTS 3,456,755 7/1969 Walker ..... 179/115.5 R 4,176,249 11/1979 Inanaga et al. ..... 179/115.5 DV

*Primary Examiner*—A. D. Pellinen
*Assistant Examiner*—Danita R. Byrd
*Attorney, Agent, or Firm*—Steele, Gould & Fried

[57] ABSTRACT

An electrodynamic loudspeaker radiates sound in all directions and with a high output for a low and medium sound frequencies. It comprises two hemispherical movable diaphragms which are arranged on either side of a disc-shaped carrier part. The diaphragms are connected with the carrier part by flanges and constitute a pulsating sphere. In this sphere and connected in each case with one of the diaphragms are actuating units with permanent magnets and in each case, an oscillatory coil. Each oscillatory coil is connected to its respective diaphragm through stiff transition parts, preferably in the form of spherical shells. Openings are provided for an atmospheric pressure equalization between the interior and exterior of the breathing sphere.

14 Claims, 3 Drawing Figures

ELECTRODYNAMIC LOUDSPEAKER FOR LOW AND MEDIUM SOUND FREQUENCIES

BACKGROUND OF THE INVENTION

1. Field of the Invention

This invention relates to an electrodynamic loudspeaker, for low and medium sound frequencies, having a movable diaphragm, an oscillatory coil connected to this diaphragm and, in the area of an air gap a magnetic assembly. The magnetic assembly includes permanent magnets which can be traversed by an alternating current which represents an electric signal to be converted into audible sound.

2. Prior Art

In known loudspeakers of this kind the diaphragm is either of funnel, dome or calotte shape. When set into oscillation it transmits sound in a selected direction. From this it follows that for good stereophonic or quadrophonic sound reproduction known loud speakers have to be arranged in such a way that the sound waves emitted therefrom converge at one point or one area in which the listeners should be located. This leads to drawbacks and limitations, firstly regarding the positioning of the loudspeaker and secondly in relation to the number of listeners who can be located in the preferred listening area. In addition, known loudspeakers have to be installed in cabinets, for example of closed box form or bass reflex cabinets, and in some cases must have carefully calculated acoustic screening or dampening to avoid any acoustic short circuiting with sound waves radiated from the rear side of the diaphragm. These known loudspeakers arranged in boxes or cabinets are therefore frequently bulky and due to the additional cost of the cabinet, relatively expensive.

It is recognised that the total acoustic output of a loudspeaker is proportional to the radiating outer face, the square of the amplitude of movement of the diaphragm and the square of the frequency. Otherwise stated, in a loudspeaker of the known kind, the diaphragms act substantially as a piston, the radiating face of which is proportional to the square of the diameter of the circle defined by the outer edge of the diaphragm. As a consequence in the case of low sound frequencies, and for a prescribed diameter of diaphragm, the amplitude of the movement of the diaphragm must be large to achieve a high acoustic sound output.

SUMMARY OF THE INVENTION

It is an object of the present invention to mitigate the disadvantages of known loudspeakers and to provide an electrodynamic loudspeaker of the type first set forth above which radiates sound substantially in all directions and which, for a prescribed diameter of the diaphragm, has a clearly larger acoustic sound output than known loudspeakers with the same movement of the diaphragm or, with a smaller motion of the diaphragm, obtains the same acoustic sound output as known loudspeakers.

These and other objects are achieved by an electrodynamic loudspeaker for low and medium range audible frequencies having a first movable diaphragm and a first oscillatory unit having an oscillatory coil connected to the first diaphragm, arranged in an air gap in a first magnetic assembly including permanent magnets, and adapted to be traversed by an alternating current representing an electrical signal to be converted into audible sound, comprising:

the first diaphragm being substantially hemispherical;

a second substantially hemispherical diaphragm identical in form to the first diaphragm connected to a second oscillatory coil arranged in an air gap of a second magnetic assembly and adapted to be traversed by the same current;

a disc-shaped carrier part having the two magnetic assemblies secured to its middle part, the first diaphragm arranged on one side thereof, and the second diaphragm arranged on the other side;

the two oscillatory coils being arranged coaxially with one another, substantially coaxially with the carrier part and on opposite sides of the carrier part;

two rigid transition parts connecting the first and second oscillatory coils to the first and second diaphragms respectively;

first and second yieldable support rings connecting rims of the first and second diaphragms respectively with the carrier part;

the two diaphragms together constituting a closed body of substantially spherical form and the two diaphragms moving in opposite directions at right angles to the carrier part when traversed by the current; and, means for equalizing atmospheric pressure within and outside the closed body.

Each of the two transition parts may be of spherical shell form with an apex thereof secured to the respective oscillatory coil and the arcuate edge thereof connected to the respective hemispherical diaphragm.

An acoustic short circuit is thus prevented because the fluctuations in sound pressure emerging from the rear sides of the two diaphragms cannot reach the exterior but remain within the closed body where, if need be, they can be absorbed by suitable material.

Advantageously the two transition parts are in the form of a spherical shell which in each case has its apex secured to an oscillatory coil and its arcuate margin connected to its associated diaphragm.

A loudspeaker of this nature, when energised with an electrical signal, acts like a pulsating sphere to send the sound waves emanating therefrom practically uniformly in all directions, without there being any preferred direction. As a result it is no longer necessary for a listener to be in any preferred direction of reception of the sound waves, or to seek an area where a number of preferred sound radiation directions are thought to converge.

Moreover the loudspeaker may be placed in any position without regard to specific or peculiar local circumstances affecting acoustic radiation. In addition the output surface of this loudspeaker is substantially the same as that of the sphere defined by the two diaphragms. Thus, for a prescribed diameter, the total acoustic output of the loudspeaker according to the invention is in the neighbourhood of four times that of a loudspeaker with a funnel diaphragm, assuming the same displacement of diaphragm in the two cases. Stated otherwise, a substantially lesser movement of the diaphragm of the loudspeaker according to the invention in comparison with a funnel diaphragm of a known loudspeaker can achieve the same acoustic sound output. Further the diaphragms of the loudspeaker of this invention have, despite their relatively large diameter, a high degree of mechanical stiffness because of their shape. Finally there is no need to arrange the loudspeaker of the invention in a box or, as already stated, to dampen the sound waves at the rear side of the diaphragm. The loudspeaker may simply be hung above a suitable fastening device, for example hung from an arm or a console.

BRIEF DESCRIPTION OF THE DRAWINGS

Further features of the invention are disclosed in the following description of two preferred, but not limiting embodiments of the invention with reference to the drawings wherein.

DETAILED DESCRIPTION OF THE PREFERRED EMBODIMENTS

Figure 1:
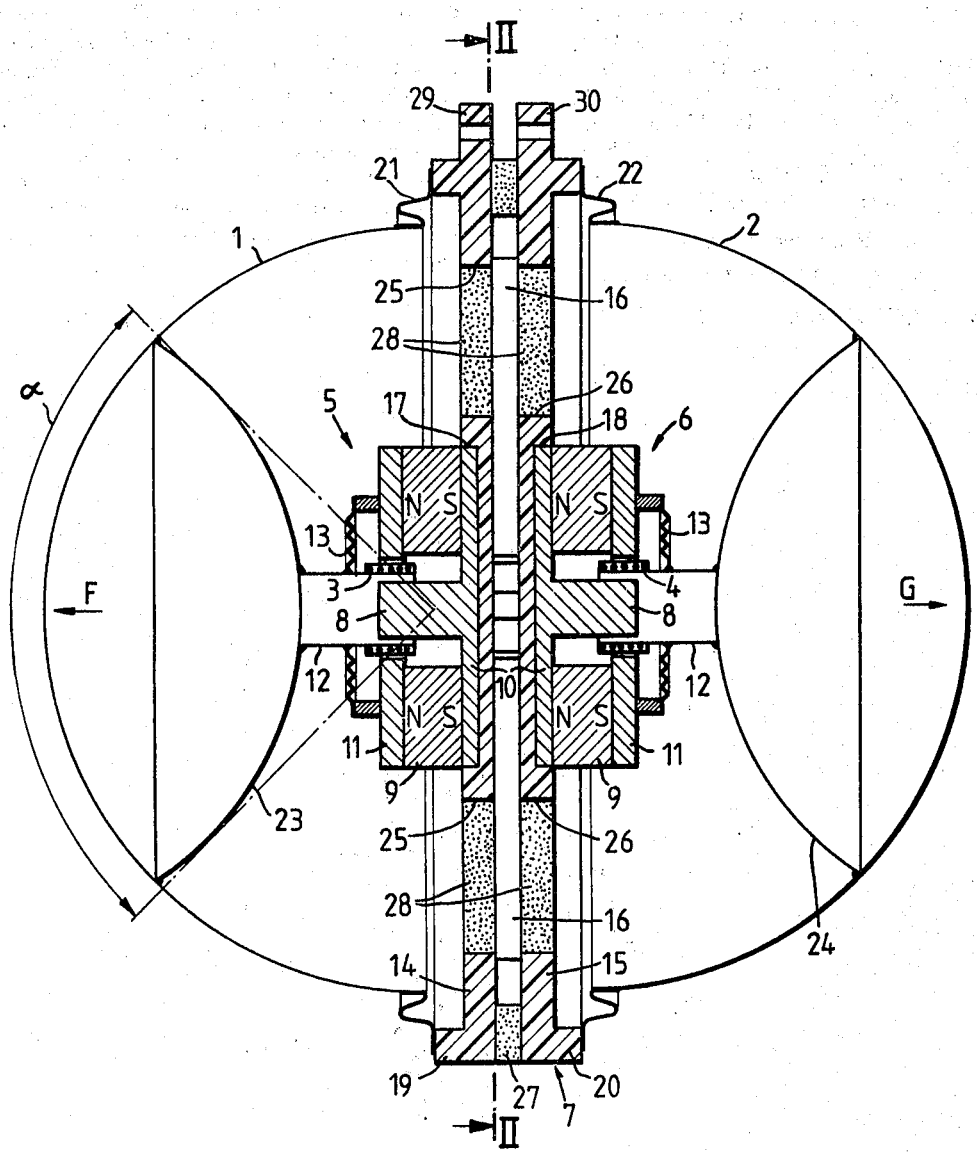
FIG. 1 is a longitudinal section on a peripheral circle through a loudspeaker in accordance with the invention.

The loudspeaker illustrated in FIG. 1 has two diaphragms 1, 2 of hemispherical form provided with oscillatory coils 3, 4. Each coil 3, 4 is a part of what is in total two actuating units 5, 6 which are secured to the central region of a carrier part 7 of disc form. The two actuating units 5, 6 are identical to one another and made in known fashion. Each actuating unit 5, 6 has a core 8 of soft iron, an annular permanent magnet 9, which is concentric with the core 8, a yoke 10 of soft iron connected to the core 8 and in contact with a face of the magnet 9, and an annular pole shoe 11 of soft iron connected to the other face of the magnet 9 and defining, with the free end part of core 8, an annular gap in which the corresponding osillatory coil 3, 4 can move axially. Each of the two oscillatory coils 3 and 4 is wound in known fashion and is held, for example by adhesion, on a cylindrical coil carrier 12 of uniform diameter. A centering ring 13 of commercial construction, hereafter referred to as the spinner, ensures the retention and centering of the coil carrier 12 and the oscillatory coils 3 and 4 within their air gap, thus ensuring that the parts 3 or 4 and 12 can move freely in the axial direction in the air gap.

The carrier part 7 of FIG. 1 is made up of two parallel plates 14 and 15, each of disc form. These are held together in spaced relation by stays 16. As can be seen from FIG. 2 the stays are of elongated form and extend radially between the two plates 14, 15 and reinforce both. The plates 14, 15 can be made of a plastics material or a nonmagnetic metal. Other materials are possible. The stays 16 are integrally connected to the plates 14 and 15 but they could be cemented to one or the other of them. The two plates 14, 15 are connected by adhesion to the free faces of the stays 16.

Each of the two plates 14, 15 has in its central area and at the outer side a circular recess, 17 or 18 respectively, in which the magnet assembly 8 to 11 of the actuating unit 5 or 6 is inserted and secured. By this means the two actuating units 5, 6 are accurately centered relative to the corresponding plate 14 or 15 and are disposed coaxially relative to one another. Likewise this keeps the oscillatory coils 3, 4 coaxial with one another. Further each of the two plates 14, 15 has a peripheral annular projection, 19, 20 respectively, which is integral with the plates 14 or 15 but could be separate. In the latter event it is cemented to the outer face of the plate 14 or 15 along the outer periphery of the latter. Two support rings 21, 22, hereinafter referred to as collars, are cemented on the one hand to the outer rim respectively of, in each case, one of the two diaphragms 1 and 2 and on the other hand to the projections 19 and 20 of the plates 14 and 15. The two diaphragms 1, 2 are thereby centered relative to the plates 14, 15 and to the actuating units 5, 6 carried by the plates 14, 15. The two collars 21, 22 correspond to those of conventional loudspeakers and allow the diaphragm 1 or 2 concerned complete freedom of movement in the axial direction.

The diaphragms 1 and 2 are desirably as lightweight as possible so that they represent very small inert masses. On the other hand they must be as stiff as possible to prevent their deformation during movement, which would produce inherent vibrations. The whole of the diaphragms 1 and 2 can be made of pasteboard by conventional methods or from a cotton-silk weave impregnated with a varnish, for example, nitrocellulose varnish. Practical tests have shown that diaphragms 1, 2 made in this way have an outstanding stiffness despite being of relatively large dimensions (the diameter of both diaphragms was 20 cm). This stiffness is also important because of their spherical form.

Each of the two diaphragms 1, 2 is connected to a corresponding coil carrier 12 through a stiff transition part 23 and 24 respectively. Each of these two parts 23, 24 run into the corresponding diaphrgms 1 or 2 at a right angle and in an area which is sufficiently spaced from the apex of the associated diaphragm. Thus each of the diaphragms 1, 2 move as a one non-deformable piece without any deformation by the forces which are transmitted thereto through the transition parts 23 and 24 and from the axial movements of the oscillatory coils 3, 4. Advantageously the transition parts 23 and 24 are connected to the corresponding diaphragms 1 and 2 at points disposed on a conical surface defining a cone angle alpha of 60° to 90°. Like the diaphragms 1, 2 the transition parts 23 and 24 must be as lightweight as possible so as to represent an inert mass of minimum weight. On the other hand they are desirably as stiff as possible so that they do not deform and are able to transmit the movements of the oscillatory coils 3 and 4 to the two diaphragms 1 and 2 without any loss. In the present example the transition parts 23, 24 are made of a stiff plastics material but they could also be of pasteboard.

As shown in FIG. 1 the transition parts 23, 24 preferably have a spherical shell form, thus conferring a high degree of stiffness. As can be seen from FIG. 1 each of the two transition parts 23, 24 is firmly connected at an apex area thereof with the free edge of the associated coil carrier 12 and connected at their circular rim or margin with the associated diaphragm 1, 2. This connection of the transition parts with the coil carriers and the diaphragms 1 and 2 preferably is performed by adhesion or cementing. The diameter of the spherical shell transition parts 23, 24 is 10 cm in the embodiment described.

In the loudspeaker described above the two diaphragms 1 and 2 act as a pulsating or "breathing" sphere when the oscillatory coils 3 and 4 are activated by the electrical signal to be converted into sound waves. The two oscillatory coils 3 and 4 are electrically connected so that the diaphragms 1 and 2 vibrate in two opposite directions symmetrically to the central plane of the disc carrier part 7. The directions of movement are indicated with arrows F and G in FIG. 1 indicating the moment when both diaphragms 1 and 2 move away from the carrier part 7.

Means are provided to equalise the inner pressure in the sphere formed by the two diaphragms 1, 2 with the outside pressure. For this purpose in the embodiment illustrated circular openings 25 and 26 are provided in one or the other plates 14 and 15 in the areas within the stays 16.

As a result, communication is provided between the volumes of air between the diaphragm 1 and the plate 14 and the diaphragm 2 and the plate 15, and the space between the two plates 14 and 15. In turn this space communicates with the outer atmosphere, that is to say the environment around the sphere formed by the two diaphragms 1 and 2, thus providing the required equalisation of pressure. This will prevent emmission of any disturbing sound waves which might come from pressure fluctuations in the volume-changing space within the sphere defined between the diaphragms 1 and 2, particularly in the plane of the carrier part 7. These sound pressure waves are in counterphase and could engender acoustic short circuits. To prevent this a seal ring 27 for atmospheric equalisation is provided between the two plates 14 and 15 at their peripheral or marginal areas. It may for example be of a resilient foamed material or an air-permeable plastics material. A labyrinthic seal has proven advantages. Plugs 28 of a resilient foamed material or of an air-permeable plastics material are arranged in the openings 25 and 26 of the plates 14 and 15 to suppress additional parasitic sound waves at frequencies other than desired and interference effects. The outwardly facing side faces of the two plates 14 and 15 are covered with a suitable absorbent material (not shown) to prevent reflection from the side faces.

Figure 2:
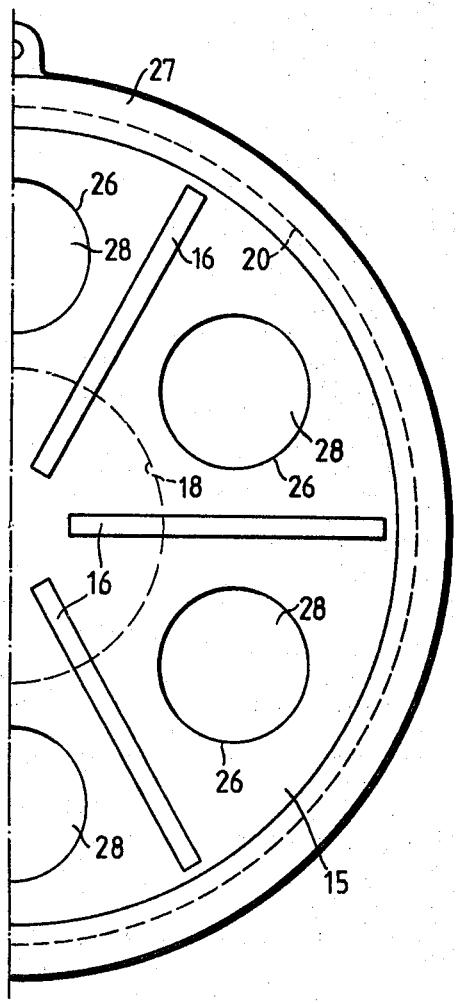
FIG. 2 is the righthand half of a split view along the line II—II of FIG. 1; and, FIG. 3 is a partial section corresponding to FIG. 1 of a second embodiment, namely with only one plate used as the support part and a modified arrangement of the magnets.

As shown in FIGS. 1 and 2, at least one of the two plates 14 and 15, or advantageously both, have fastening flanges 29 and 30 which as shown by FIG. 1 are arranged opposite to one another and are provided with a hole for fastening the loudspeaker to a support arm (not shown). Suspension from any other suitable carrier means is possible.

Figure 3:
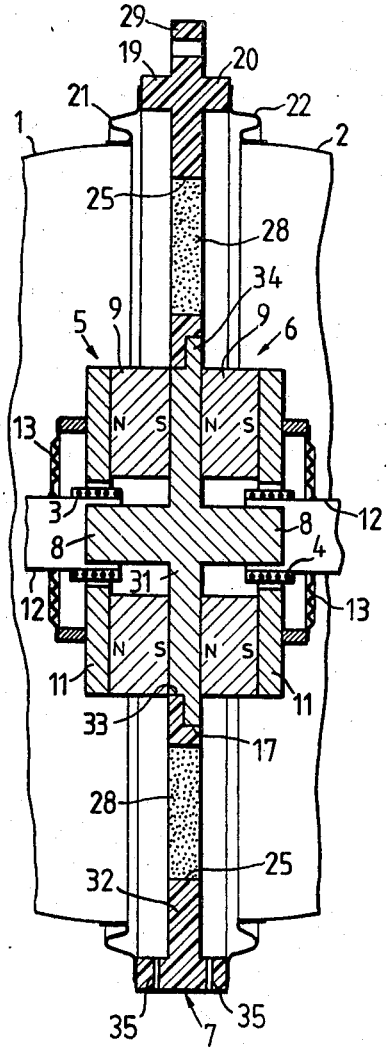

FIG. 3 shows a second embodiment of the loudspeaker. The same reference numerals are used for like parts to those in the preceding case. The difference between this second embodiment, shown in FIG. 3, and the first embodiment lies in combining the two actuating units 5 and 6 into a double unit 5, 6 and suspending them together.

As shown in FIG. 3 the two cores 8 are integral with a plate 31 which serves as a yoke. The core 8 and the yoke 31 are of soft iron. Two annular magnets 9 of suitable polarity are secured to the two sides of the yoke 31. The carrier part 7 is formed by a single plate 32 of disc form which has a central opening 33. One of the two faces of this plate 32 has a recess 17 concentric with the central opening 33 and having therein a circular collar 34 which is integral with the yoke 31. The double actuating unit 5, 6 is inserted in the central opening 33, the collar 34 thereof engaging in the recess 17 and being cemented into this. As a result, the double actuating unit 5, 6 is disposed symmetrically in relation to the central plane of the plate 32. There are two peripheral projections 19 and 20 integral with the plate 32 although they could be separate parts cemented to the plate. This plate 32 has openings 25 for the equalisation of pressure described above between the two sides of the carrier part 7, and these openings 25 could again be closed by plugs 28 of a resilient foamed material or an air-permeable plastics material. Communication openings in the form of radial openings 35 are provided in the two projections 19, 20 to allow for the atmospheric pressure balance between the volumes of air within the sphere defined by the two diaphragms 1 and 2 and the exterior, for example in the area of the fastening flange 29. It is advantageous to provide, on at least one side face of the plate 32 and between the opening 25, radial ribs or stays similar to the stays 16 of FIG. 2, thereby providing for stiffening of the plate 32. Likewise it is very advantageous to cover both side faces of the plate 32 with a sound-absorbing material.

In both embodiments of the invention described above the two oscillatory coils 3 and 4, when excited by an electrical signal to be converted into sound waves, move in opposite directions. The movements thereof are transmitted through the transition parts 23, 24 to the two diaphragms 1 and 2 to cause the latter to make a reciprocating movement and to convert the electrical signal into sound pressure fluctuations. Although the first two diaphragms 1 and 2 move in opposite directions, that is to say vibrate in counterphase along the axial direction of the two oscillatory coils 3 and 4, one will find that the intensity of output of the loudspeaker of this invention in the direction of arrow F and of arrow G (FIG. 1) is substantially the same as in a direction normal to this. Otherwise stated, the sound output from the loudspeaker according to this invention is practically the same in all directions.

The examples described above are given merely by way of example and represent no kind of restriction of the invention, further embodiments being possible. Thus, for example the volumes enclosed between parts 1, 23 and 2, 24 may be filled with a very light sound-absorbing material to prevent reflections of the inner sound waves between the diaphragms 1 and 2 and the transition parts 23 and 24 of spherical shell form connected to them. Further to the same end, the transition parts 23 and 24 could have the same radius as the diaphragms 1 and 2 to which they are connected and be cemented to these not only linearly along their circular edges but over the whole of a spherical part-surface in order to stiffen the central zone of the diaphragms 1 and 2. In the latter event the transmission of the mechanical forces takes place through the relevant coil carrier 12, which now is substantially longer than that described above, and also are of substantially larger diameter, as is therefore in turn a part of the transition part 23, 24. However, larger actuating units 5, 6 are needed in this case.

It is further possible, in addition to the carrier part 7 being located on a pole circle, to provide a carrier part on an equatorial plane, and instead of using two diaphragms 1 and 2, to make the sphere from four diaphragms of equal size. In this case four actuating units become necessary, these being arranged X-fashion relative to one another. A flange is also provided in the equatorial plane.

Finally it has been found very advantageous if the centers of the spherical diaphragms coincide.

Independent of the special construction, however, the important feature of the invention lies in the fact that the actuating units 5, 6 are disposed within the sphere defined by the diaphragms 1, 2.

I claim:

1. An electrodynamic loudspeaker for low and medium range audible frequencies having a first movable diaphragm and a first oscillatory unit having an oscillatory coil connected to the first diaphragm, arranged in an air gap in a first magnetic assembly including permanent magnets, and adapted to be traversed by an alternating current representing an electrical signal to be converted into audible sound, comprising:

the first diaphragm being substantially hemispherical;

a second substantially hemispherical diaphragm identical in form to the first diaphragm connected to a second oscillatory coil arranged in an air gap of a second magnetic assembly and adapted to be traversed by the same current;

a disc-shaped carrier part having the two magnetic assemblies secured to its middle part, the first diaphragm arranged on one side thereof, and the second diaphragm arranged on the other side thereof;

the two oscillatory coils being arranged coaxially with one another, substantially coaxially with the carrier part and on opposite sides of the carrier part;

two rigid transition parts connecting the first and second oscillatory coils to the first and second diaphragms respectively;

first and second yieldable support rings connecting rims of the first and second diaphragms respectively with the carrier part;

the two diaphragms together constituting a closed body of substantially spherical form and the two diaphragms moving in opposite directions at right angles to the carrier part when traversed by the current; and, means for equalizing atmospheric pressure within and outside the closed body.

2. An electrodynamic loudspeaker for low and medium range audible frequencies having a first movable diaphragm and a first oscillatory unit having an oscillatory coil connected to the first diaphragm, arranged in an air gap in a first magnetic assembly including permanent magnets, and adapted to be traversed by an alternating current representing an electrical signal to be converted into audible sound, comprising:

the first diaphragm being substantially hemispherical;

a second substantially hemispherical diaphragm identical in form to the first diaphragm connected to a second oscillatory coil and adapted to be traversed by the same current;

a disc-shaped carrier part having the two magnetic assemblies secured to its middle part, the first diaphragm arranged on one side thereof, and the second diaphragm arranged on the other side thereof;

the two oscillatory coils being arranged coaxially with one another, substantially coaxially with the carrier part and on opposite sides of the carrier part;

two rigid transition parts connecting the first and second oscillatory coils to the first and second diaphragms respectively, each of the transition parts being of spherical form with an apex thereof secured to the respective oscillatory coil and the arcuate edge thereof connected to the respective hemispherical diaphragm;

first and second yieldable support rings connecting rims of the first and second diaphragms respectively with a carrier part;

the two diaphragms together constituting a closed body of substantially spherical form and the two diaphragms moving in opposite directions at right angles to the carrier part when traversed by the current; and, means for equalizing the atmospheric pressure within and outside the closed body.

3. A loudspeaker according to claim 1 or 2, wherein the carrier part comprises two disc-shaped, parallel plates which are held in spaced relationship by stiffening stays and each of which has a marginal projection, a collar being secured to each of the projections.

4. A loudspeaker according to claim 3, wherein each of the two plates has on the outer side thereof, in a central region, a circular recess for receiving the respective magnetic assembly, which is cemented thereto.

5. A loudspeaker according to claim 3, wherein the means for equalizing the atmospheric pressure comprises the two plates, having openings, and a balancing opening provided between the space between the two plates and the exterior.

6. A loudspeaker according to claim 5, further comprising a sealing ring of an air permeable material provided in the marginal areas of the two plates.

7. A loudspeaker according to claims 1 or 2, wherein the carrier part comprises a single disc-shaped plate having a central opening and two projections facing in opposite directions, a collar being secured to each, the two magnetic assemblies being combined to form a coherent double block which is inserted and cemented in the central opening.

8. A loudspeaker according to claim 7, wherein the means for equalizing the atmospheric pressure comprises each projection having at least one radial opening.

9. A loudspeaker according to claim 5, further comprising plugs of an air permeable material disposed in the openings.

10. A loudspeaker according to claim 1 wherein the carrier part comprises at least one fastening flange for attachment to a carrier arm.

11. A loudspeaker according to claim 4, wherein the means for equalizing the atmospheric pressure comprises the two plates having openings, and a balancing opening provided between the space between the two plates and the exterior.

12. A loudspeaker according to claim 5 further comprising a labyrinthic seal disposed in the marginal areas of the two plates.

13. A loudspeaker according to claim 8, further comprising the plate having at least one opening.

14. A loudspeaker according to claim 8, further comprising plugs of an air permeable material disposed in the openings.

* * * * *